US010619981B2

(12) United States Patent
Ryu

(10) Patent No.: US 10,619,981 B2
(45) Date of Patent: Apr. 14, 2020

(54) DUAL-FUNCTION PENETRATOR LINER FOR MULTIFUNCTIONAL WARHEAD

(71) Applicant: AGENCY FOR DEFENSE DEVELOPMENT, Daejeon (KR)

(72) Inventor: Chi-Young Ryu, Yongin-si (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 128 days.

(21) Appl. No.: 15/938,039

(22) Filed: Mar. 28, 2018

(65) Prior Publication Data

US 2018/0283831 A1 Oct. 4, 2018

(30) Foreign Application Priority Data

Mar. 31, 2017 (KR) ..... 10-2017-0041514

(51) Int. Cl.
*F42B 1/028* (2006.01)
*F42B 12/10* (2006.01)
*F42B 12/22* (2006.01)

(52) U.S. Cl.
CPC ..... *F42B 1/028* (2013.01); *F42B 12/10* (2013.01); *F42B 12/22* (2013.01)

(58) Field of Classification Search
CPC .... F42B 1/02; F42B 1/028; F42B 3/08; F42B 12/10; F42B 12/16; F42B 12/18
USPC ..... 102/306, 307, 308, 309, 476
See application file for complete search history.

(56) References Cited

U.S. PATENT DOCUMENTS 3,478,685 A * 11/1969 Thomanek ..... F42B 1/028 102/306
4,499,830 A * 2/1985 Majerus ..... F42B 1/032 102/307
4,979,443 A * 12/1990 Rittel ..... F42B 1/028 102/307
5,509,357 A * 4/1996 Lawther ..... F42B 12/10 102/307
6,279,480 B1 * 8/2001 Roosmann ..... F42B 12/10 102/236
6,349,649 B1 * 2/2002 Jacoby ..... F42B 1/028 102/306
2003/0183113 A1 * 10/2003 Barlow ..... F42B 1/028 102/476

FOREIGN PATENT DOCUMENTS

EP 0252385 B1 * 5/1990 ..... F42B 1/028
GB 1237392 A 6/1971
GB 2319592 B * 9/1998 ..... F42B 1/028
JP 2010169318 A * 8/2010 ..... F42B 1/028
KR 10-1346238 B1 1/2014

OTHER PUBLICATIONS

English translation of JP 2010-169318 A (Year: 2010).*

* cited by examiner

*Primary Examiner* — James S Bergin
(74) *Attorney, Agent, or Firm* — LRK Patent Law Firm

(57) ABSTRACT

A dual-function penetrator liner for a multifunctional warhead. A dome-shaped outer portion is disposed in an inner front end of a warhead body to be concave in a direction opposite to a direction in which the warhead body is fired. A fastening portion is disposed in an outer circumferential direction of the outer to fasten the outer portion to the warhead body. A conical central portion is enclosed by the outer portion to protrude in a direction opposite to the direction in which the warhead body is fired. The outer portion and the central portion are concentric.

5 Claims, 8 Drawing Sheets

DUAL-FUNCTION PENETRATOR LINER FOR MULTIFUNCTIONAL WARHEAD

CROSS REFERENCE TO RELATED APPLICATION(S)

This application claims the benefit of Korean Patent Application No. 10-2017-0041514, filed Mar. 31, 2017, which is hereby incorporated by reference in its entirety into this application.

BACKGROUND OF THE PRESENT INVENTION

1. Technical Field

The present invention relates generally to a dual-function penetrator liner for a multifunctional warhead, having dual functions of fragments and an explosively formed penetrator. More particularly, the present invention relates to a dual-function penetrator liner designed to overcome degradations in penetration performance of the penetrator, which would otherwise be caused by, for example, components disposed in the front portion of a guided missile, while ensuring the ability to penetrate a target, by adding liner shape of a shaped charge to a central portion thereof.

2. Description of Related Art

Representative types of directional-energy warheads having a mechanism of concentrating explosive energy of main charge to destroy a target, such as an armored target, use a shaped charge warhead and an explosively formed penetrator. A shaped charge has a sufficient amount of energy able to penetrate an armored target, since a level of pressure generated when a superfast jet generated by the main charge energy thereof collides against the armor significantly exceeds the yield strength of a material of the armor. An explosively formed penetrator is formed by a mechanism similar to that of the shaped charge. However, the speed of the penetrator ranges from 2 km/sec to 4 km/sec, which is slower than the jet tip speed of the shaped charge (typically ranging from 7 km/sec to 9 km/sec). The shape of the penetrator is similar to the shape of a penetrator of a kinetic energy warhead, i.e. a single slug, instead of being similar to an elongated jet shape. A typical shaped charge warhead has an elongated configuration, since the inner angle of a liner thereof is fundamentally smaller than that of the explosively formed penetrator to generate high penetration force. Due to this configuration, at the same warhead length, the shaped charge has a smaller amount of main charge charged therein than the explosively formed penetrator. In a configuration of a multifunctional warhead using a metal jet or a penetrator while using a warhead body as fragments, the use of a liner of a shaped charge reduces the absolute amount of high explosive main charge charged therein. This, however, reduces explosive energy of main charge transferred to fragments, thereby making it difficult to realize multiple functions. The explosively formed penetrator is advantageous in realizing multiple functions of forming fragments and functioning as a penetrator, since a greater amount of main charge can be charged, due to the axial length of the liner being relatively short in relation to the overall length of the warhead body. However, when a warhead having multiple functions of forming fragments and functioning as an explosively formed penetrator is constructed and actually operated in a guided missile, the penetration performance of the explosively formed penetrator is lowered by interferences with, for example, components disposed in front of the warhead. The components disposed in front of the warhead are made of a variety of materials, such as steel, aluminum, and plastic. Due to this feature, kinetic energy of the penetrator may be rapidly lost, so that penetration energy of the penetrator may be completely exhausted before the penetrator arrives at a target. That is, when a warhead having a conventional explosively formed penetrator, as described above, is disposed within a guided missile, the explosively formed penetrator may not have penetration force capable of actually destroying a target, since penetration energy is exhausted by interferences with components in front of the warhead after the warhead is detonated.

SUMMARY OF THE PRESENT INVENTION

Accordingly, the present invention has been made keeping in mind the above problems occurring in the prior art, and an object of the present invention is to provide a dual-function penetrator liner for a multifunctional warhead, embodied by adding a liner shape of a shaped charge to a liner of an explosively formed penetrator for a multifunctional warhead, thereby overcoming the problems in that obstructions of front components or the like make it impossible to form an explosively formed penetrator, and that an insufficient amount of charged main charge is used, which may be a drawback of the shaped charge.

Specifically, when main charge within a guided missile is detonated, the liner having the shape of a shaped charge, which is faster than the explosively formed penetrator, expands as a jet to penetrate and rupture front components in advance to the explosively formed penetrator. Then, the explosively formed penetrator is ejected along the path formed by the liner, so that the amount of penetration energy lost by the front components is minimized. Accordingly, the dual-function penetrator liner for a multifunctional warhead can concurrently perform multiple functions of generating fragments, generating a jet, and functioning as a shaped penetrator.

In order to accomplish the above object, the present invention provides a dual-function penetrator liner for a multifunctional warhead, having functions of forming fragments and functioning as an explosively formed penetrator. The penetrator liner may include: a dome-shaped outer portion disposed in an inner front end of a warhead body to be concave in a direction opposite to a direction in which the warhead body is fired; a fastening portion disposed in an outer circumferential direction of the outer to fasten the outer portion to the warhead body; and a conical central portion enclosed by the outer portion to protrude in a direction opposite to the direction in which the warhead body is fired, wherein the outer portion and the central portion are concentric.

The dual-function penetrator liner for a multifunctional warhead according to the present invention is designed such that the ratio of the diameter of the central portion with respect to the outer portion is a predetermined value. With this configuration, a shaped charge jet, which is faster than an explosively formed penetrator, removes front components, and then the slower explosively formed penetrator is ejected along a path formed by the jet to minimize the loss of penetration energy. Accordingly, a single warhead can concurrently perform multiple functions of generating fragments, generating a jet, and functioning as a shaped penetrator.

In addition, the dual-function penetrator liner for a multifunctional warhead according to the present invention can also be used as a follow-through warhead in which a superfast shaped charge (i.e. jet) forms a penetration hole in armor and then an explosively formed penetrator passes through the penetration hole formed by the jet, thereby destroying the interior of a target.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
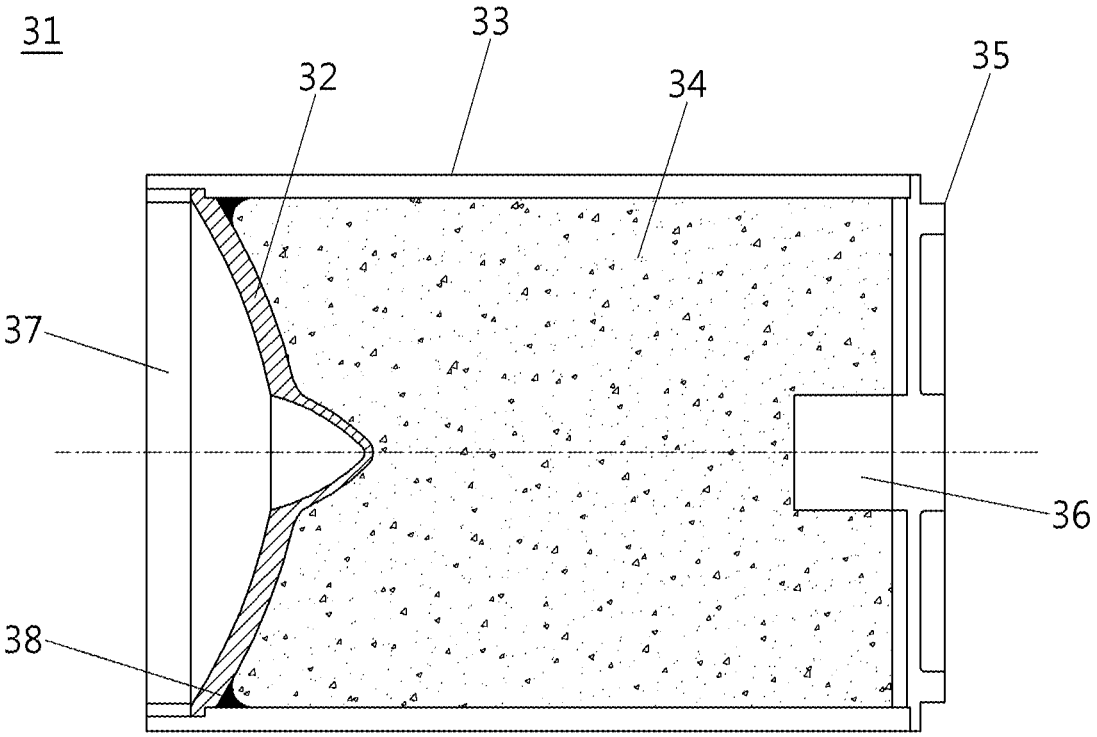
FIG. 1 is a cross-sectional view illustrating a configuration of a multifunctional warhead equipped with a dual-function penetrator liner for a multifunctional warhead according to the present invention.

For better understanding of the present invention, exemplary embodiments of the present invention will be described with reference to the accompanying drawings. The embodiments of the present invention may be modified in many different forms and the scope of the present invention should not be limited to the embodiments set forth herein. Rather, these embodiments are provided so that this disclosure will be thorough and complete, and will fully convey the concept of the present invention to those skilled in the art. In the drawings, the shapes and dimensions may be exaggerated for clarity, and the same reference numerals will be used throughout to designate the same or like components. Detailed explanations of known related functions and constitutions may be omitted to avoid unnecessarily obscuring the subject matter of the present invention.

The present invention relates to a dual-function penetrator liner 32 for a multifunctional warhead, having dual functions of forming fragments and functioning as an explosively formed penetrator. The dual-function penetrator liner 32 includes: a dome-shaped outer portion 32*b* disposed in an inner front end of a warhead body 33 to be concave in a direction opposite to a direction in which the warhead body 33 is fired; a fastening portion 32*c* disposed on the outer circumference of the outer portion 32*b* to fasten the outer portion 32*b* to the warhead body 33; and a central portion 32*a* enclosed by the outer portion 32*b* to protrude in the direction opposite to the direction in which the warhead body 33 is fired. The outer portion 32*b* and the central portion 32*a* are concentric.

The maximum diameter D2 of the central portion 32*a* is about 30% of the maximum diameter D1 of the outer portion 32*b*.

The thicknesses of the components are measured in a direction in which a guided missile is fired.

The thickness t1 of the outer portion 32*b* is about 3% to 5% of the maximum diameter D1 of the outer portion 32*b*, while the thickness t2 of the central portion 32*a* is about 2% to 4% of the maximum diameter D2 of the central portion 32*a*.

The fastening portion 32*c* is stepped along the outermost peripheral portions of the outer portion 32*b*.

In the dual-function penetrator liner 32 for a multifunctional warhead according to the present invention, when a multifunctional warhead 31 functioning as fragments and an explosively formed penetrator is disposed within a guided missile, the dual-function penetrator liner 32 can destroy a target by minimizing a decrease in kinetic energy of the explosively formed penetrator by removing interferences from front components or the like. FIG. 1 is a cross-sectional view illustrating a configuration of the multifunctional warhead 31 equipped with the penetrator liner 31 having dual functions for a multifunctional warhead according to the present invention. FIG. 1 is given for better understanding of the shape and fastening method of the dual-function penetrator liner for a multifunctional warhead according to the present invention.

Figure 2A:
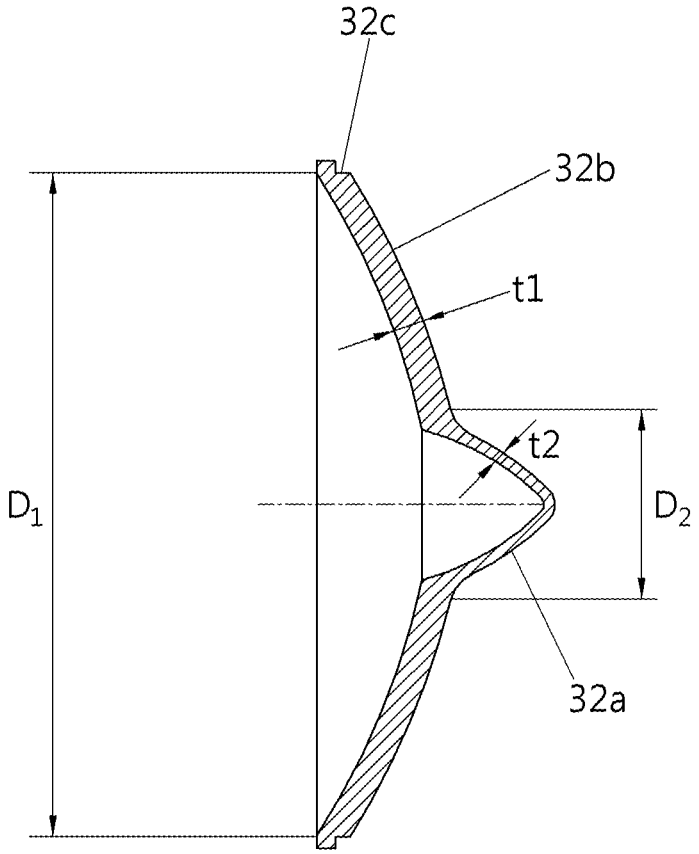
FIGS. 2A and 2B are a cross-sectional view and a perspective view illustrating the dual-function penetrator liner for a multifunctional warhead according to the present invention.
Figure 2B:
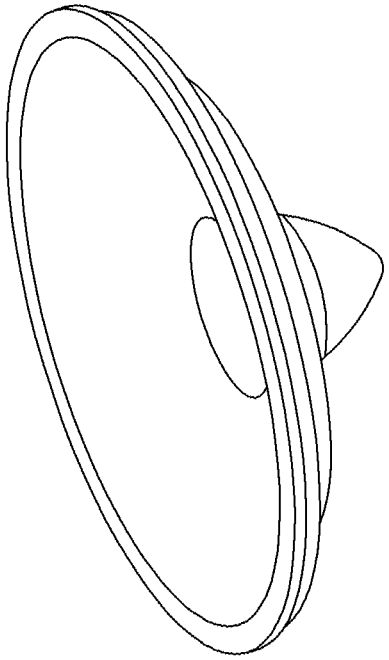
Figure 3A:
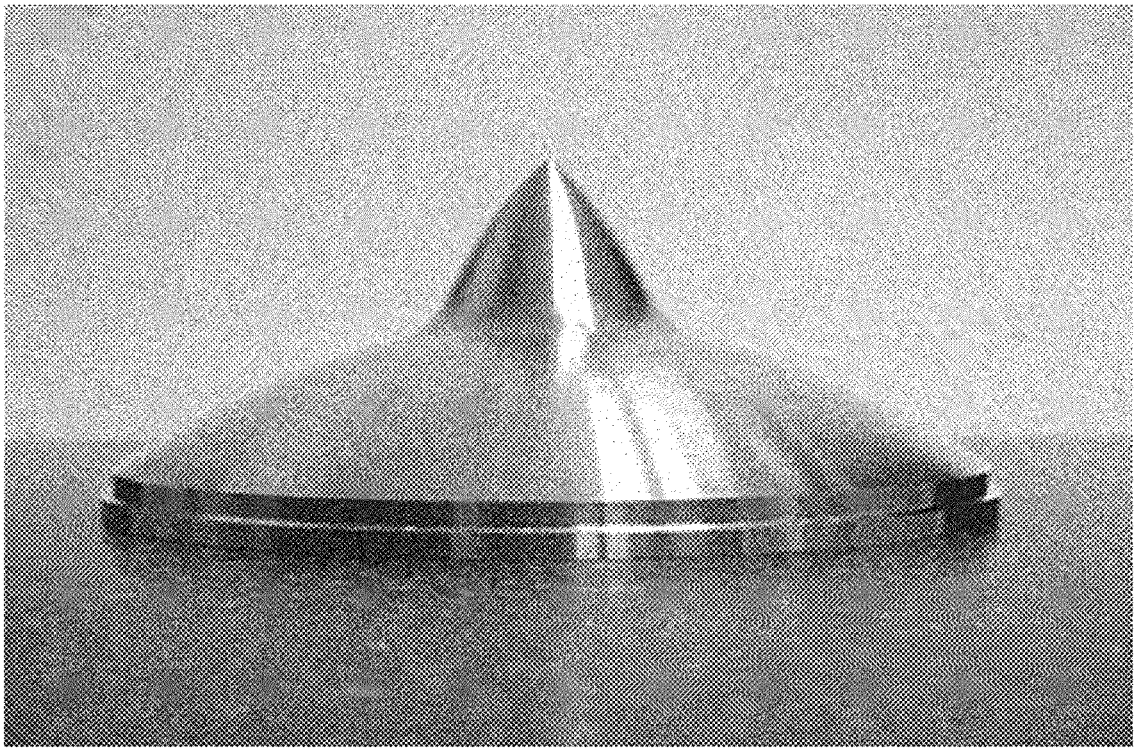
FIGS. 3A and 3B are a front image and a top image illustrating a dual-function penetrator liner for a multifunctional warhead according to the present invention.
Figure 3B:
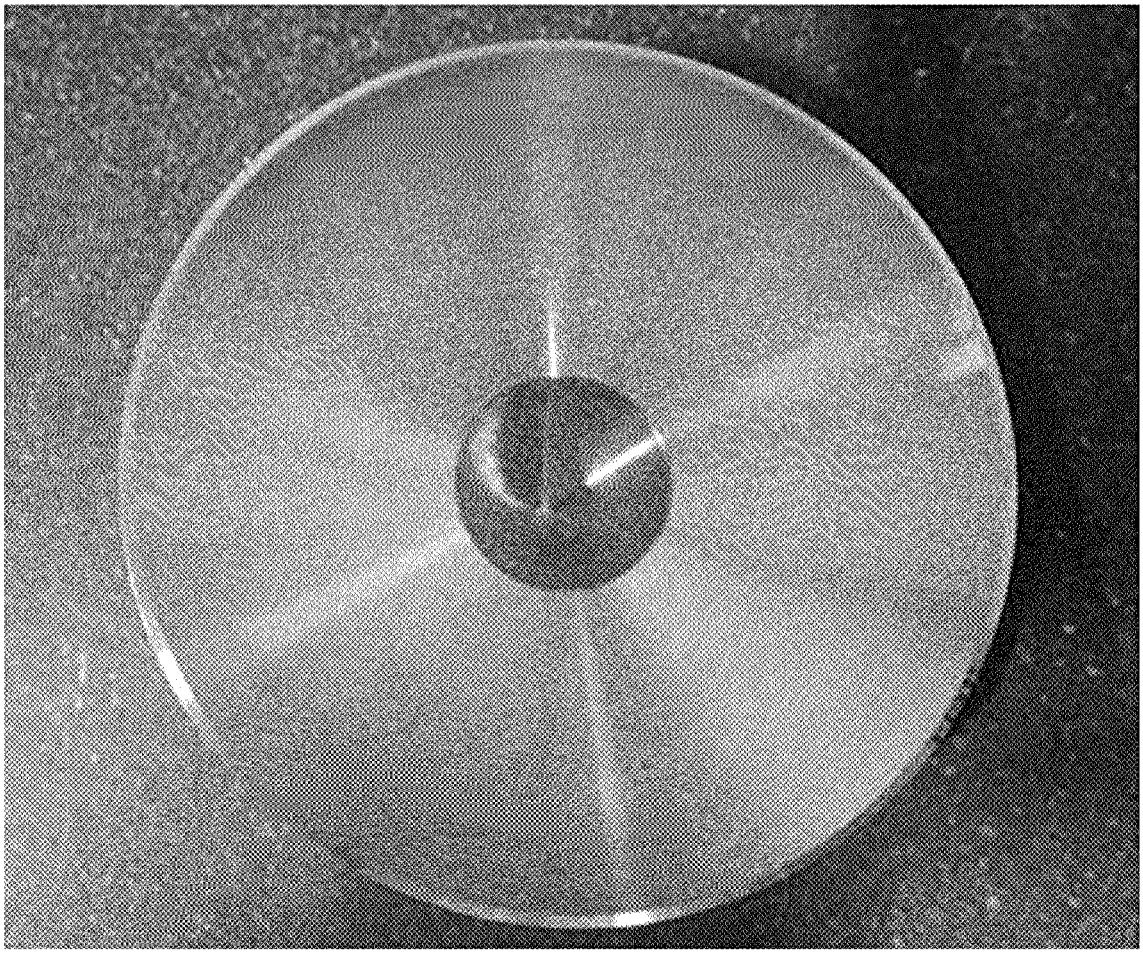

FIGS. 2A and 2B are a cross-sectional view and a perspective view illustrating the dual-function penetrator liner for a multifunctional warhead according to the present, invention.

As apparent from FIGS. 1, 2A, and 2B, the central portion 32*a* has the shape of a shaped charge, and the outer portion 32*b* has the shape of an explosively formed penetrator. FIG. 2A is the cross-sectional view of the dual-function penetrator liner for a multifunctional warhead, illustrating the diameters and thicknesses of respective portions. The maximum diameter D1 of the outer portion is the diameter of the outer portion 32*b* adjoining the inner surface of the warhead body 33. The maximum diameter D2 of the central portion means the diameter of a round-machined edge portion of the central portion adjoining the outer portion, i.e. the maximum diameter of the portion machined to be round.

The ratio of the maximum diameter D1 of the outer portion with respect to the maximum diameter D2 of the central portion must be a specific value to maximize an effect of removing the front components in the guided missile (obtained by the central portion) and an effect of penetrating a target (obtained by the outer portion). When analysis and experiment were performed by using the ratio of the maximum diameters between the outer portion 32*b* and the central portion 32*a* as a variable, it was determined that optimal penetration performance can be obtained when the maximum diameter of the central portion is 30% of the maximum diameter of the outer portion. This can be represented by the following formula 1:

$$D_2/D_1 \cong 0.3, \qquad \text{[Formula 1]}$$

where D1 is the maximum diameter of the outer portion, and D2 is the maximum, diameter of the central portion.

In addition, although the explosively formed penetrator for a multifunctional warhead may be designed such that the thickness thereof is variable, optimal performance can be obtained only in the case that the thicknesses of respective portions are predetermined ratios of the diameter of the dual-function penetrator liner 32 for a multifunctional warhead. Specifically, the thickness t2 of the central portion is about 2% to about 4% of the maximum diameter D2 of the central portion, while the thickness t1 of the outer portion is about 3% to about 5% of the maximum diameter D1 of the outer portion. These can be represented by the following formulas 2 and 3:

$$0.03 \le t_1/D_1 \le 0.05 \quad \text{[Formula 2]}$$

$$0.02 \le t_2/D_2 \le 0.04, \quad \text{[Formula 3]}$$

where D1 is the maximum diameter of the outer portion, D2 is the maximum diameter of the central portion, t1 is the thickness of the outer portion, and t2 is the thickness of the central portion.

Figure 4A:
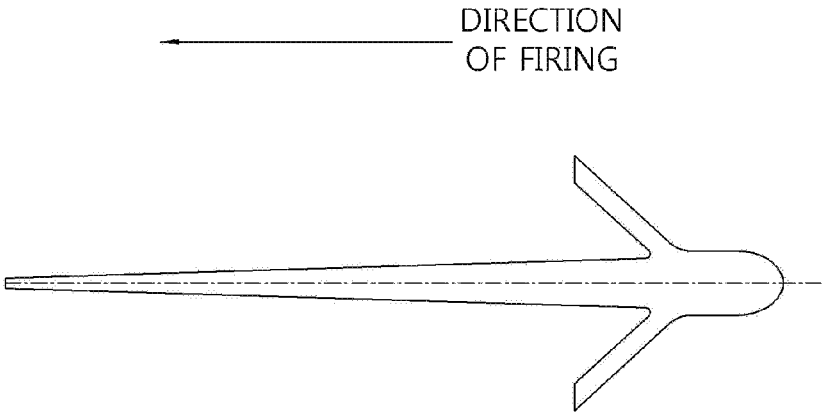
FIG. 4A PRIOR ART
FIG. 4A is a schematic view illustrating a metal jet generated by a typical shaped charge warhead.
Figure 4B:
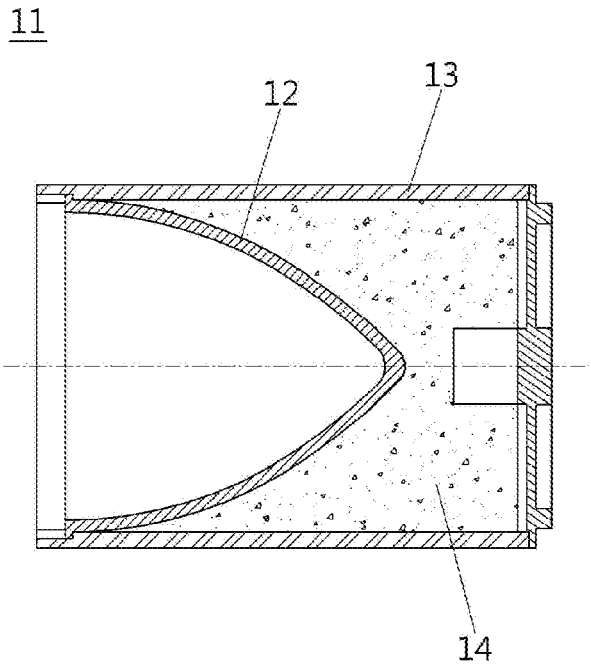
FIG. 4B PRIOR ART
FIG. 4B is a schematic view illustrating the shaped charge warhead.
Figure 5A:
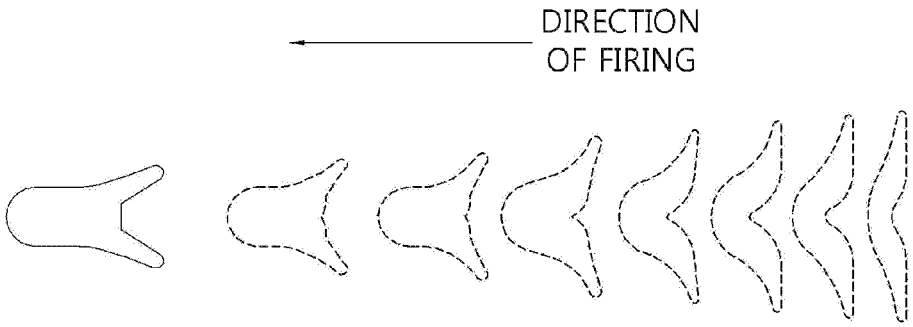
FIG. 5A PRIOR ART
FIG. 5A is a schematic view illustrating a penetrator generated by a typical explosively formed penetrator warhead.
Figure 5B:
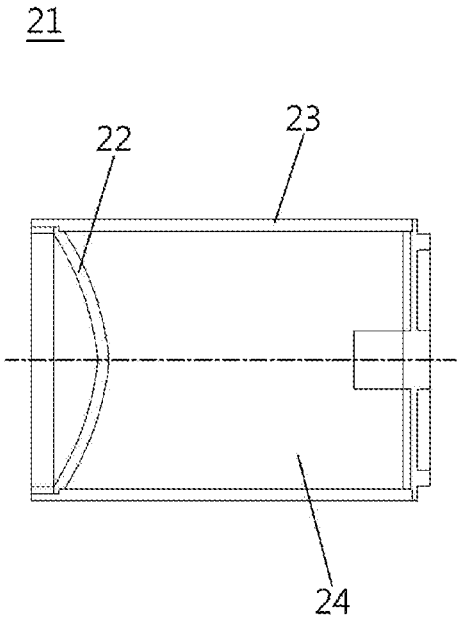
FIG. 5B PRIOR ART
FIG. 5B is a schematic view illustrating the explosively formed penetrator warhead.

FIG. 4A is a schematic view illustrating a metal jet generated by a typical shaped charge warhead, and FIG. 4B is a schematic view illustrating the shaped charge warhead. In addition, FIG. 5A is a schematic view illustrating a penetrator generated by a typical explosively formed penetrator warhead, and FIG. 5B is a schematic view illustrating the explosively formed penetrator warhead. Referring to FIGS. 4A, 4B, 5A, and 5B, a shaped charge liner 12 and a detonator tube are concentric, while an explosively formed penetrator liner 22 and a detonator tube are concentric. These configurations are intended to maximize the explosive performance of guided missiles. The dual-function penetrator liner 32 for a multifunctional warhead according to the present invention is also configured to be concentric with a detonator tube 36.

Next, the explosion sequence of the guided missile, to which the dual-function penetrator liner for a multifunctional warhead according to the present invention is applied, will be described. In response to an explosive signal being received from a fuse disposed in a rear cover 35 at the rear of the multifunctional warhead 31, explosive energy of an electric explosive tube detonates the detonator tube 36 and then detonates a main charge 34 within the warhead. Then, first, the warhead body 33 made of a metal, forming the shell of the warhead, is fragmented by expansion and rupture, due to the explosive energy of the main charge 34 transferred thereto. In subsequence, the explosive energy of the main charge 34 is transferred in the axial direction of the warhead, thereby arriving at the central portion 32*a* of the dual-function penetrator liner 32 for a multifunctional warhead, prior to the outer portion 32*b*. The central portion 32*a* is collapsed by the explosive energy, thereby being deformed into a metal jet having a jet tip speed of about 7 km/sec to about 9 km/sec. The metal jet is ejected to the front of the guided missile, thereby penetrating and rupturing components disposed in front of the guided missile. Afterwards, the explosive energy is transferred to the outer portion 32*b*, causing the outer portion 32*b* to be self-forged into the shape of a penetrator. The self-forged penetrator, i.e. the outer portion 32*b*, is ejected forwardly from the guided missile at a speed of about 2 km/sec to about 4 km/sec. Since the outer portion 32*b* having the shape of a penetrator is ejected along a path obtained as a hollow space, penetrated and ruptured by the central portion 32*a* in the shape of a metal jet, a decrease in the penetration by interferences with the front components is reduced. In other words, the dual-function penetrator liner 32 for a multifunctional warhead is deployed into a shape having two functions, i.e. forming a metal jet and an explosively formed penetrator, by the explosive energy of main charge.

Figure 6:
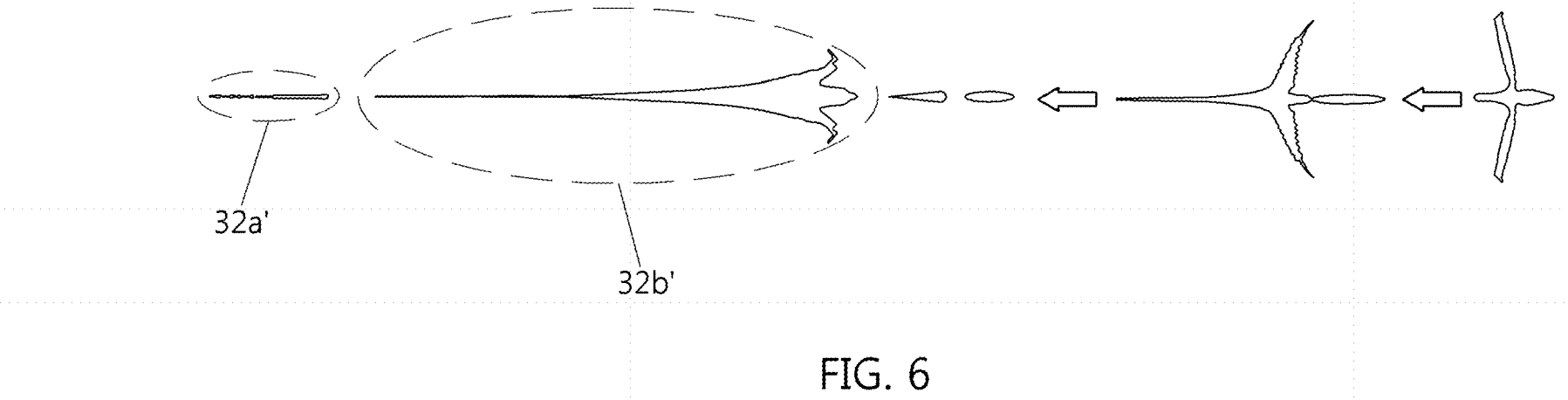
FIG. 6 is a schematic view illustrating changes in the shape of a dual-function penetrator liner for a multifunctional warhead, over time, after being fired.

FIG. 6 is a schematic view illustrating changes in the shape of a dual-function penetrator liner for a multifunctional warhead, over time, after being fired. Referring to FIG. 6, the shape of the dual-function penetrator liner 32 for a multifunctional warhead is gradually deformed, in the direction from right to left. As in the right part of FIG. 6, at an early stage of firing, both the central portion 32*a* and the outer portion 32*b* are ejected. Gradually, the central portion is ejected ahead due to the faster speed thereof, and the outer portion follows after the central portion. Afterwards, as in the left part of FIG. 6, the central portion 32*a*' proceeds, separated from the outer portion 32*b*'.

When the dual-function penetrator liner 32 for a multifunctional warhead is connected to a warhead 33 designed to form fragments, the dual-function penetrator liner 32 is fixed to the warhead 33 using a locking nut 37, since the concentricity of assembly is important for obtaining a predetermined level of penetration performance. Afterwards, adjoining portions of the warhead body 33 and the dual-function penetrator liner 32 for a multifunctional warhead are sealed using an adhesive 38 or the like. This can consequently remove gaps, through which the main charge 34, i.e. a castable plastic bonded explosive, or the like may leak when injected through the rear portion of the warhead body. It is advantageous for increasing penetration force when shockwaves of explosive energy are symmetrically transferred due to detonation occurring at the center of the warhead. Thus, the detonator tube 36 is disposed to be accurately located in the central portion of the main charge 34, using a charging tool or the like, so that the detonator tube 36 and the main charge 34 are set to be concentric when the main charge 34 is cured.

Although the exemplary embodiments of the present disclosure have been described for illustrative purposes, a person skilled in the art will appreciate that various modifications and other equivalent embodiments are possible without departing from the essential characteristics of the present disclosure. It should be understood that the present invention is not limited to the foregoing particular embodiments but the technical scope of the present invention shall be defined by the technical spirit of the appended Claims. In addition, it should be understood that the present invention shall embrace all modifications, equivalents, and substitutions within the spirit and scope of the present invention defined by the appended Claims.

What is claimed is:

1. A multifunctional warhead including a warhead body and a dual-function penetrator liner which has functions of forming fragments and functioning as an explosively formed penetrator, wherein the dual-function penetrator liner comprises:

a dome-shaped outer portion disposed in an inner front end of the warhead body to be concave in a direction opposite to a direction in which the warhead body is fired;

a fastening portion disposed in an outer circumferential direction of the outer portion to fasten the outer portion to the warhead body; and a conical central portion enclosed by the outer portion to protrude in a direction opposite to the direction in which the warhead body is fired, wherein the outer portion and the central portion are concentric, and wherein thickness of the outer portion is larger than thickness of the central portion to obtain an optimal penetration performance, and the fastening portion is stepped along an outermost peripheral portion of the outer portion.

2. The multifunctional warhead according to claim 1, wherein a maximum diameter of the central portion is about 30% of a maximum diameter of the outer portion.

3. The multifunctional warhead according to claim 2, wherein the thicknesses of the outer portion and the central portion are measured in the direction in which the warhead body is fired.

4. The multifunctional warhead according to claim 3, wherein the thickness of the outer portion is about 3% to about 5% of a maximum diameter of the outer portion.

5. The multifunctional warhead according to claim 4, wherein the thickness of the central portion is about 2% to about 4% of a maximum diameter of the central portion.

* * * * *